United States Patent [19]

Woodbridge

[11] 3,945,734

[45] Mar. 23, 1976

[54] SELF CAPPING LIQUID APPLICATORS

[76] Inventor: Richard C. Woodbridge, 56 William St., Princeton, N.J. 08540

[22] Filed: May 19, 1975

[21] Appl. No.: 578,980

[52] U.S. Cl. ..... 401/198; 401/108; 401/117; 15/185

[51] Int. Cl.[2] ..... B43K 5/00; B43K 5/16

[58] Field of Search ..... 401/198, 199, 202, 107, 401/108, 117, 91, 59, 60, 269, 243–246, 262; 15/184, 185; 132/88.5, 88.7

[56] References Cited

UNITED STATES PATENTS 2,957,452 10/1960 Brannon ..... 401/108

FOREIGN PATENTS OR APPLICATIONS 989,253 5/1951 France ..... 401/59

*Primary Examiner*—Lawrence Charles

*Attorney, Agent, or Firm*—Behr & Woodbridge

[57] ABSTRACT

An absorbent tipped liquid applicator apparatus is equipped with a mechanism for selectively capping and uncapping the tip in response to manual pressure. The applicator includes an absorbent tip and a body which normally contains a reservoir of fluid. A flexible sleeve is attached to the body at one end. A spring loaded sleeve retractor is connected to the other end of the sleeve and is flexibly attached to the body of the applicator also. In its capping mode, the sleeve is drawn over the absorbent tip and is clamped there by the retractor means. When the retractor means is squeezed, it opens up the end of the sleeve and withdraws it so as to effectively uncap the tip. Releasing the manual pressure on the retracting means causes the sleeve to return to its capping mode position. This technique can be applied to nylon tipped pens, felt tipped marking and highlighting pens, glue sticks, shoe polish applicators and the like.

17 Claims, 14 Drawing Figures

PRIOR ART
16
24
32
30
14
10
12
22
18
20
26
28

FIG. 6
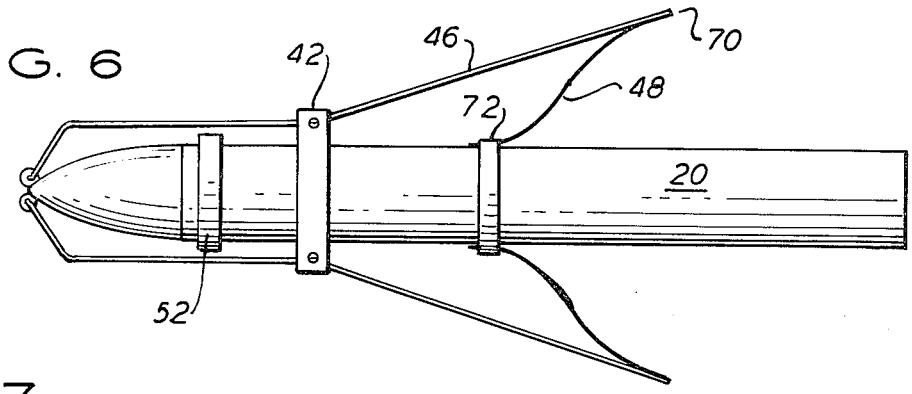
FIG. 7
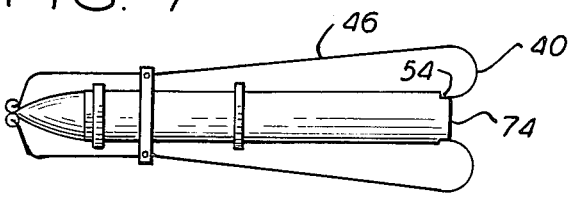
FIG. 8
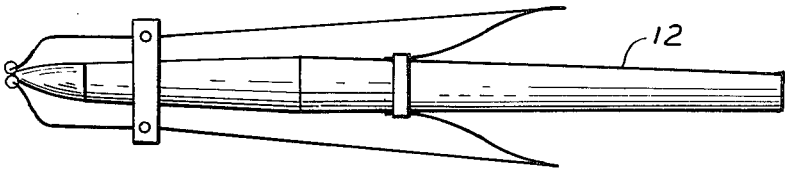
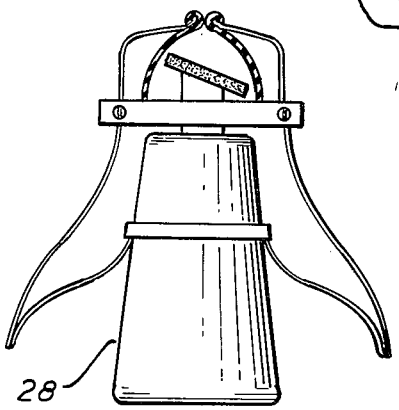
FIG. 9
FIG. 10
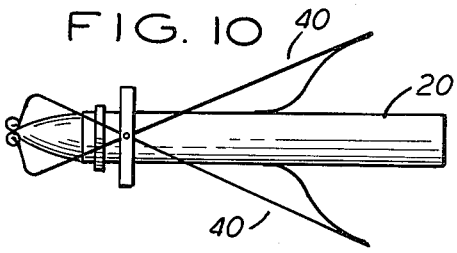
FIG. 11
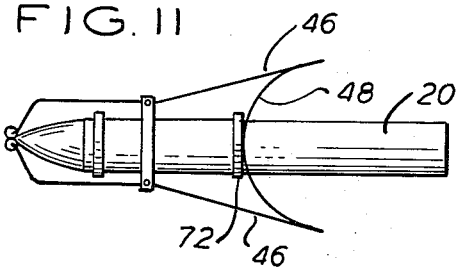
FIG. 12
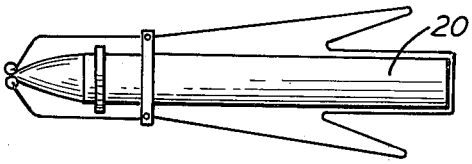

SELF CAPPING LIQUID APPLICATORS

BACKGROUND OF THE INVENTION

1. Field of the Invention

This apparatus relates to liquid applicators in general and, in particular, to a device for selectively uncapping the applicator tip of a liquid applicator in response to manual pressure and for automatically recapping the liquid applicator in the absence of said manual pressure.

2. Description of the Prior Art

Absorbent or wick tipped liquid applicators are known to those of ordinary skill in the art. Typical of such devices are the now common nylon tipped writing pen or the felt tipped markers often used for both writing and highlighting. Some glues are often kept in wick tipped containers. Additionally, liquid shoe polishes may be stored and applied from applicators including a sponge top wick.

One of the major problems associated with such prior art devices is the difficulty of keeping them securely capped when not in use. Often, during the course of use, the user will forget to recap the applicator, or the user may keep the cap off the applicator for a long period of time without recapping. Or, the cap may be defective in some manner. The capping problem, in turn, leads to undesired evaporation of the liquid. Evaporation not only depletes the liquid supply in the body of the reservoir, but it often leaves a hard residue on the surface of the applicator tip, thereby reducing its pliability and absorbency. In order to overcome this problem, a means was sought which would automatically recap a liquid applicator between applications. Additionally, a means was sought whereby the user could uncap and cap the applicator tip with the pressure of just one hand.

There are some relevant references in the prior art to mechanisms for protecting the tip of a liquid applicator. A common example is the retractable ball point pen.

Fallows, British Pat. No. 118,130 dated Aug. 22, 1918 discloses a fountain pen having a split cap. The cap automatically opens by sliding the pen forward into the writing position. Lo Curto, U.S. Pat. No. 2,097,160 discloses a fountain pen protector where the writing tip of the fountain pen is protected by a trap door type of lid.

The use of split fingers to protect a liquid tip is disclosed by Koeln U.S. Pat. No. 3,583,820. In that patent, the fingers surround the writing tip of a ball point pen and are spread by the forward movement of the tip carrying apparatus.

Crane, U.S. Pat. No. 207,256 and Mureau U.S. Pat. No. 2,582,451 disclose mechanisms for selectively exposing a brush tip then withdrawing that tip into a protective enclosure. Johnston, U.S. Pat. No. 602,806 discloses a spring loaded mechanism for withdrawing a sponge tipped liquid applicator into a protected cavity.

While the foregoing prior art appears to be relevant with respect to the present invention it does not disclose or in any way render obvious the unique features of the invention.

SUMMARY OF THE INVENTION

A conventional liquid applicator generally includes some sort of absorbent applicating tip or wick and a body which contains a fluid reservoir. Sometimes the fluid in the reservoir is free to slosh around; sometimes the fluid is absorbed in a matrix of material such as nylon or felt which delivers fluid to the tip by capillary action.

According to the disclosure, the present invention comprises a flexible sleeve which surrounds the tip of a liquid applicator and a sleeve retractor or retracting means which withdraws the sleeve in response to manual pressure. The sleeve retracting means preferably includes a pair of spring loaded steel levers which are attached at one end to the sleeve and at the other end flexibly associated with the body of the applicator. The levers are connected pivotally to a common sliding fulcrum means which moves backwards and forwards in response to the applied pressure. Between the lever pivot point and the end attached to the body, the lever is bent back upon itself at an angle between 0° and 90°.

When pressure is applied to the lever means by squeezing the two levers towards each other the tip of the flexible sleeve is caused to open and to withdraw from around the wick in such a manner as to expose the wick above the opening of the sleeve. In this manner, the applicator may be held and used for either applying ink, polish, glue, or translucent liquids, etc. When the user is finished using the applicator, he or she will then place it down at which point the cap will return to its normally capped position due to the spring loaded nature of the levers. The self-capping mechanism can be applied to a wide variety of well-known liquid applicators including but not limited to nylon tipped pens, felt tipped markers, shoe polish applicators, glue sticks and the like.

According to alternative embodiments, the lever material may be constructed from a springy metal or a plastic with suitable characteristics. Additionally, instead of bending the lever back upon itself, it may be possible to laminate springy material together in such a way as to achieve the same results without bending.

These and other features of the present invention will be more fully understood with reference to the following drawings.

BRIEF DESCRIPTION OF THE DRAWINGS

FIG. 6 is a side view of another embodiment of the present invention wherein the spring pivot arm is not a continuous piece of the lever mechanism.

FIG. 7 is another embodiment of the present invention wherein the second end of the lever means is attached to the body of the liquid applicator at a point more distant that in the embodiments of FIGS. 1 through 6.

FIG. 8 is a cross-section of the present invention as applied to a nylon tipped writing pen instrument.

FIG. 9 is a cross-sectional view of the present invention as applied to a liquid shoe polish applicator.

FIG. 10 is another embodiment of the present invention wherein the retractor levers crisscross the body of the liquid applicator.

FIG. 11 is a side elevation of another embodiment of the present invention wherein the retractor levers are a continuous piece of resilient material.

FIG. 12 is a side view of another embodiment of the present invention wherein the retractor levers are formed from a continuous piece of resilient material that includes its own anchor means.

DESCRIPTION OF THE INVENTION

Figures 1A, 1B, 1C, 2, 3, 4, 5:
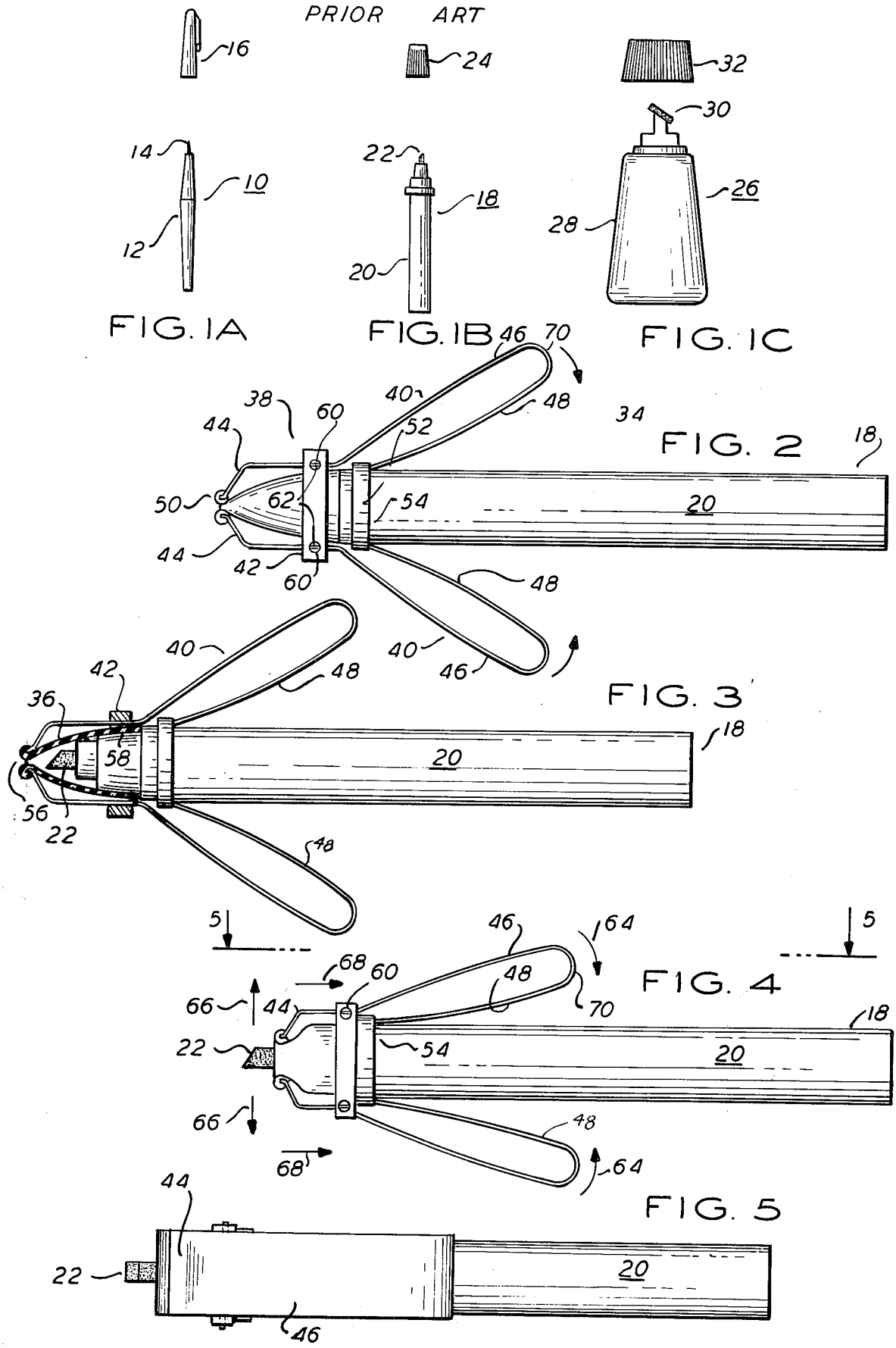
FIGS. 1*a*, 1*b*, and 1*c* illustrate prior art liquid applicators and their respective common capping devices.
FIG. 2 is a side view of one embodiment of the present invention.
FIG. 3 is a cross-sectional view of the embodiment of FIG. 2.
FIG. 4 is a side view of the embodiment of FIG. 2 with the capping sleeve in its retracted state.
FIG. 5 is a top view of the illustration of FIG. 4 as seen from perspective 5—5.

During the course of the following disclosure, like numerals will be used to indicate like elements in the different figures.

Liquid applicators of the sort known to those of ordinary skill in the art are illustrated in FIGS. 1*a*, 1*b* and 1*c*. FIG. 1*a* illustrates a common nylon tipped writing pen 10 including a body or barrel 12 which contains a fluid reservoir typically stored in a matrix or medium of absorbent material, a nylon tip 14 and a snap-on cap 16. Typically, the cap 16 is either a jam fit or a snap fit onto the body 12 of the nylon tipped pen 10. An example of a pen that was made by this technique is one known as FLAIR made by Papermate Division, The Gillette Company, Boston, Mass. 02199.

Another common fluid applicator is illustrated in FIG. 1*b* as the broad stroke felt tipped applicator 18. As with most applicators of this type, felt tipped applicator 18 includes a body 20 containing a reservoir or fluid, a tip or wick 22 communicated internally with the reservoir and a cap 24. In this case, the cap is commonly a jam fit type cap. The ink commonly used in this type of liquid applicator may be either opaque, transparent or translucent. An example of a liquid applicator made according to these specifications is known as the HI-LITER made by Carter's Ink Company, 239 First Street, Cambridge, Mass.

A slightly different but still common liquid applicator is that shown in FIG. 1*c*. The applicator of FIG. 1*c* is a shoe polish applicator 26. Applicator 26 includes a body 28 and a sponge tip 30 and a cap 32. Unlike the liquid applicators of FIGS. 1*a* and 1*b*, the shoe polish type applicator 26 typically includes a reservoir of fluid which is not contained by a medium of absorbent material. In other words, the fluid in the body 28 is free to slosh around. The liquid from the body 28 gets to the sponge tip 30 by inverting the shoe polish applicator 26 and squeezing the body 28. On the other hand, the fluid in the ink pen 10 and the felt tipped marker 18 flow to the respective tips 14 and 22 via capillary action or the like. Shoe polish applicator 26 also differs from the embodiments of FIGS. 1*a* and 1*b* in that the cap 22 is a screw-on type of cap in the typical arrangement. A common prior art shoe polish applicator of the sort just described is sold as ESQUIRE LIQUID WAX and made by the Knomark Company, Inc. of Jamaica, N.Y. 11434.

Additionally, glue sticks or the like may be made with absorbent tips. The major difficulty associated with the liquid applicators as shown in FIGS. 1*a*–1*c* is that the fluid frequently evaporates, due to poor capping. The poor capping can be attributed to either a mechanical defect in the cap itself or to human forgetfulness. For example, if a student uses the nylon tipped pen 10 or the felt marker 18 for a long period of time and does not recap the instrument after a period of hours, then a significant portion of the fluid evaporates and the life and effectiveness is greatly reduced. Additionally, snap-on fits and jam fits are generally poor airtight enclosures and after a period of time, such capping techniques frequently result in a loss of fluid. In the case of the shoe polish applicator 26 as shown in FIG. 1*c*, it is not uncommon for the user to screw the cap 32 down too tight onto the body 28 and thereby causing the cap 32 to crack and to admit unwanted atmospheric air.

The undesired evaporation of fluids in liquid applicators such as those shown in FIGS. 1*a*–1*c* have two particular undesirable side effects. The first undesirable side effect is the depletion of the fluid and the reduction of the life of the pen. The second undesirable side effect may be the hardening of the absorbent tip and its consequent unsuitability for writing or applying purposes. What was clearly desired in view of the prior art was an effective sealing cap which, when not in use, would automatically recap the absorbent tip so that there would be no consequent loss of applicator fluid or undesirable hardening of the tip.

A side elevation of an embodiment of the present invention is shown in FIG. 2. In this case, the liquid applicator is shown to be a felt tip marker 18 but it will be understood that a felt tip applicator 18 is only used as an example and that the same technique and apparatus can be applied to a nylon tip pen 10 as shown in FIG. 1*a* or to a shoe polish applicator 26 as shown in FIG. 1*c* or to many other types of applicators. For that matter, it could be applied to an open reservoir type of fluid applicator without a tip, however in its preferred mode the invention would be preferably applied to liquid applicators having an absorbent type tip.

A self-capping liquid applicator 34 according to a preferred embodiment of the present invention is illustrated in FIG. 2. The apparatus is shown in use with a felt tip type applicator such as that illustrated in FIG. 1*b*, however it will be understood that the basic technique and apparatus can be applied to nylon tipped pens such as those shown in FIG. 1*a* or liquid shoe polish applicators such as that shown in FIG. 1*c* or similar liquid applicators.

The entire apparatus is shown to basically include a rubber or plastic capping sleeve 36 and a retractor means 38. The retractor means in turn comprises a pair of levers 40 and a movable or slidable fulcrum means 42. In this case, a pair of lever means 40 is illustrated and while this is the preferred number, it may be possible to operate with more than two or with less than two as the situation may require. However, a pair of levers 40 is preferable because they can be squeezed together under hand pressure conveniently and the whole apparatus can lie relatively flat if they are on opposite sides of the apparatus. The lever means 40 are further divided into a front section 44, a back section 46 and a spring return section 48. The three sections of lever means 40, that is front section 44, back section 46 and spring return section 48 are all connected together. Lever means 40 is preferably made of a springy material such as spring steel or a flexible resilient plastic. The tip of front section 44 comprises a first end of lever 40 and is connected or bonded to the top of sleeve 36 at point 50. The other end of lever means 40 abuts against collar 52 at a second point 54. Collar 52 may be naturally molded as part of the body 20 of the felt tip marker 18 or it may be separately added in the manner of a bicycle clamp or the like. The collar 52 acts as an anchor means against which the second end 54 of lever 40 abuts.

In FIG. 3 the apparatus of FIG. 2 is shown in cross-sectional perspective. It is clear from this cut away view that the felt tip 22 is securely encapsulated within the resilient pliable rubber-like sleeve 36. The front opening 56 of sleeve 36 is automatically clamped shut by the spring loaded action of return section 48. According to a preferred embodiment, the spring return section 48 is part of a continuous piece of resilient metal which, when bent, has a pent up force within it which forces the two ends 50 of both lever means 40 against each other and thereby seals off opening 56. The other end 58 of sleeve 36 is snugly stretched over the body 20 of the marker 18 in such a fashion as to make an air tight seal at that end. Therefore with ends 56 and 58 impervious to the atmosphere, the liquid trapped within tip 22 has nowhere to evaporate. The lever 40 is pivotally connected to the fulcrum means 42 by methods known to those of ordinary skill in the art. Slidable fulcrum means 42 preferably comprises a continuous round or square frame having a set of holes or detents 60 therein or therethrough. The lever means includes a set of detent engaging tabs 62 which are free to pivot within the slidable fulcrum 42. The tension of the back spring section 48 is such as to cause the front section 44 and the back section 46 to rotate about tabs 62 and therefore with both levers 40 rotating in the same direction under the influence of spring section 48, the front section 56 of the sleeve 36 automatically closes under its own spring loaded influence.

By applying manual pressure to the back section 46 of the lever means 40 it is possible to simultaneously open the front section 46 and withdraw the sleeve 36 back behind the tip 22 of the felt tip marker 18. The manual pressure is preferably applied by squeezing the two back sections 46 between the thumb and the first or second fingers of either hand. In this fashion, the pressure of one hand is sufficient to automatically expose the tip 22 for action.

In actuality the squeezing of sections 46 in the direction indicated by arrows 64 produces two simultaneous but different movements. The first movement is a spreading movement in the direction of arrows 66 and the second movement is a withdrawing or retracting action in the direction of arrows 68. The spreading action in the direction of arrows 66 is the result of the rotation of lever section 44 and 46 about an axis of rotation which passes through detent holes 60 in the sliding fulcrum means 42. The withdrawing action in the direction of arrows 68 is the result of the fact that the back spring section 48 has an effective radius length and as the lever means 40 is pressed toward the body 20 of the felt tip marker 18 the spring pivot section 48 rotates around the second end 54. This in turn causes the bend section 70 between sections 46 and 48 to move further away from the felt tip 22. This action in turn draws the entire lever means 40 backwards and retracts the sleeve 36 from around the tip 22. In short, the application of manual pressure on back section 46 in the direction of arrows 64 causes concurrent spreading action in the direction of arrows 66 and retracting or withdrawing action in the direction of arrows 68.

In this manner, the user may pick up the pen and by squeezing the back sections 46, can render it ready for immediate use. The whole operation can be performed with one hand and after the user is finished with the applicator, he merely puts it down and the build-in, residual spring tension in section 48 causes a reaction in the direction 180° opposite those illustrated as 64, 66 and 68. Reaction ceases when the apparatus has assumed its fully capped equilibrium state as illustrated in FIG. 2. At this point, it has returned to its previously capped condition. A top view of the uncapped apparatus of FIG. 4 is seen from perspective 5—5 in FIG. 5.

A slightly modified version of the present invention is illustrated in FIG. 6. According to this embodiment, the sliding fulcrum means 42 is located on the body 20 of the felt pen 18 on the side of the collar 52 farthest away from the felt tipped point 22. This is in contrast to the embodiment of FIGS. 2–5 wherein the sliding fulcrum means 42 is located between the tip 22 and the collar 52. Additionally, the spring return section 48 is shown as having an approximately S-shaped configuration. The S-shaped spring section 48 is anchored to body 20 by an anchor means 72. Anchor means 72 may be integral with body 20 or it may be preferably fastenable on to the body 20 after the fabrication of the felt pen 18. Rear section 46 and spring section 48 are connected together at point 70. According to this embodiment, the materials comprising sections 44 and 46 may differ from materials used in section 48. Therefore, for example, section 44 and 46 may be made of a rigid plastic and section 48 may be made of a leaf spring material.

Another embodiment of the present invention is shown in FIG. 7 wherein the second end 54 of the lever 40 is flexibly attached to a recessed shelf in the butt 74 of the felt pen 18. This recessed shelf or groove serves as an anchor means and is frequently found in common felt tipped pens where it serves as a temporary cap holder while the pen is in use.

FIG. 8 illustrates the apparatus of the present invention as incorporated for use with a nylon tipped writing pen such as that illustrated as element 10 in FIG. 1*a*.

In a similar manner, the present self-capping liquid applicator apparatus is shown incorporated for use on a liquid shoe polish applicator such as that illustrated as element 26 in FIG. 1*c*.

Another modification of the present invention is illustrated in FIG. 10 wherein the opposing lever or retractor means 40 cross over each other and therefore act on opposite sides of the body from which direct pressure is applied. This technique is vaguely similar to the manner in which the bias springs of a clothespin cross one another.

According to FIG. 11, another embodiment is shown in which the spring bias member 48 is a continuous piece of springy material which extends across opposing rear section 46. Again, the spring section 48 plays against an anchor or ledge-like section 72.

Finally, another embodiment is shown in FIG. 12 wherein the retractor levers are formed from a continuous piece of resilient material that includes its own anchor means. This embodiment is quite practical since it eliminates the necessity of having an anchor means built into the liquid applicator, hence, this embodiment can be used directly with existing applicators without necessitating modification of the applicator itself.

While the invention has been described with reference to preferred embodiments, it will be understood by those skilled in the art that various changes may be made without departing from the spirit and scope of the invention.

For example, while an anchor means 72 has been described as a ledge, it could easily be a groove or some kind of band or fastening which can be later attached to the mechanism.

The capping sleeve 36 can be made from any type of suitable rubber or plastic which can stand the wear and tear of constant opening and closing. Such materials are known to those of ordinary skill in the art and are available for such purposes. Likewise, the material of the lever means 40 and the slidable fulcrum means 42 have been described as being plastic or metal. Various different types of plastic or metal would be suitable and also obvious to those of ordinary skill in the art.

With regard to the mechanism itself, it will be appreciated that the rear spring section 48 acts both as a spring and as a pivot arm. It would of course be obvious to one of ordinary skill in the art to make the spring loading element a separate part of the mechanism wherein the pivot arm 48 would then have to work in conjunction with a separate spring. This approach, while practical, would be probably uneconomical.

Finally, while the preferred embodiment of the invention is adaptable, especially to felt tipped markers, it will be obviously clear to those of ordinary skill in the art that it is adaptable to many kinds of small liquid applicators where evaporation is a problem.

It should be borne in mind that not only does the disclosed invention allow for the automatic recapping of a liquid application, it also has several other advantages too. One particular advantage is that the capping and uncapping operation can be performed with just two fingers of one hand. This feature is especially important for those who are handicapped or those who, for one reason or another, cannot use a second hand to uncap or cap the liquid applicator.

As was stated previously, the foregoing embodiments are illustratively only and there are other modifications that would be obvious to those of ordinary skill in the art given the foregoing teaching.

I claim:

1. A capping apparatus for capping and uncapping a liquid applicatior having a wick-like tip and a liquid containing reservoir body, said apparatus comprising:

a hollow, flexible, capping sleeve means attached at one end to said applicator body; and, a retracting means also connected to said sleeve and to said applicator body for selectively retracting and spreading said sleeve in response to manual pressure and for automatically returning said sleeve to a capping position in the absence of manual pressure.

2. The apparatus of claim 1 wherein said retracting means comprises:

a lever means; and, a moveable fulcrum means connected to said lever means.

3. The apparatus of claim 2 wherein said lever means has a first end attached to said sleeve means, a second end adapted for engagement with said body, and an intermediate fulcrum section; and, wherein said sulcrum means is pivotally connected to the fulcrum section of said lever means.

4. The apparatus of claim 3 wherein said lever means comprises a plurality of levers.

5. The apparatus of claim 4 wherein that portion of the lever means lying between the fulcrum section and the second end of said lever means is further divided into at least two sub-sections, wherein the angle subtended between the two sub-sections is an angle greater than 0° but less than 90°.

6. The apparatus of claim 5 wherein that section of the lever means lying between the fulcrum section and the second end is bent back upon itself.

7. The apparatus of claim 5 wherein said two sub-sections comprise two pieces of material attached together at one end thereof.

8. The apparatus of claim 4 wherein said levers are constructed from a metal having spring-like qualities.

9. The apparatus of claim 4 wherein said levers are constructed from a plastic-like material having spring-like qualities.

10. The apparatus of claim 4 wherein the sleeve means is tapered towards the wick tip of the applicator when said sleeve is in position on the body of said applicator.

11. The apparatus of claim 4 wherein said applicator comprises a nylon tip pen.

12. The apparatus of claim 4 wherein said applicator comprises a felt tipped pen means.

13. The apparatus of claim 4 wherein said applicator comprises a liquid shoe polish applicator.

14. The apparatus of claim 4 wherein said apparatus further includes anchor means for flexibly connecting the second end of said lever means to the body of said applicator.

15. The apparatus of claim 14 wherein said anchor means comprises a ledge integral with the body of said applicator.

16. The apparatus of claim 14 wherein the anchor means comprises a means fastenable to the body of the applicator and against which the second end of said lever means is flexibly adaptable.

17. The apparatus of claim 14 wherein said anchor means is built into said lever means.

* * * * *